US006690117B2

(12) United States Patent
Komiya

(10) Patent No.: US 6,690,117 B2
(45) Date of Patent: Feb. 10, 2004

(54) DISPLAY DEVICE HAVING DRIVEN-BY-CURRENT TYPE EMISSIVE ELEMENT

(75) Inventor: Naoaki Komiya, Kobe (JP)

(73) Assignee: Sanyo Electric Co., Ltd. (JP)

( * ) Notice: Subject to any disclaimer, the term of this patent is extended or adjusted under 35 U.S.C. 154(b) by 0 days.

(21) Appl. No.: 10/080,812

(22) Filed: Feb. 22, 2002

(65) Prior Publication Data

US 2002/0175635 A1 Nov. 28, 2002

(30) Foreign Application Priority Data

Feb. 26, 2001 (JP) ..... 2001-050921

(51) Int. Cl.[7] ..... G09G 5/00
(52) U.S. Cl. ..... 315/169.3; 345/76
(58) Field of Search ..... 315/169.1–169.4; 345/55, 76–82, 100–103

(56) References Cited

U.S. PATENT DOCUMENTS 6,011,529 A 1/2000 Ikeda ..... 345/77
6,204,610 B1 * 3/2001 Komiya ..... 315/169.3
6,369,785 B1 * 4/2002 Imai ..... 345/76
6,414,443 B2 * 7/2002 Tsuruoka et al. ..... 315/169.3
6,421,033 B1 * 7/2002 Williams et al. ..... 345/55

FOREIGN PATENT DOCUMENTS

EP 0 923 067 6/1999
JP 2000-267628 9/2000

* cited by examiner

*Primary Examiner*—Wilson Lee
(74) *Attorney, Agent, or Firm*—Cantor Colburn LLP

(57) ABSTRACT

A current control circuit is provided between a power source circuit and a power source line VL which supplies a drive current to an organic EL element provided in each emissive pixel of a display panel. An amount of current flowing from the power source circuit to the power source line VL is detected, and when the amount of current increases, a power source voltage Vdd to be applied to the power source line VL is decreased, thereby decreasing a current flowing thorough the organic EL element. Alternatively, contrast or brightness level of display data to be supplied to each EL element is controlled in accordance with the detected amount of current, so that when the current amount increases, the contrast or brightness level is reduced thereby restricting a current flowing through the organic EL element. Thus, the amount of current flowing through the organic EL element can be restricted to thereby prevent excessive power consumption of the display device.

20 Claims, 6 Drawing Sheets

DISPLAY DEVICE HAVING DRIVEN-BY-CURRENT TYPE EMISSIVE ELEMENT

BACKGROUND OF THE INVENTION

1. Field of the Invention

The present invention relates to a display device having an emissive element which is driven by current (hereinafter referred to as driven-by-current type emissive element) such as an organic electroluminescence (EL) element.

2. Description of Related Art

Electroluminescence (EL) display devices having an EL element, which is a driven-by-current type emissive element, in each pixel are advantageous in that they are self-emissive type, are thin and consume a small amount of power. Therefore, EL display devices have attracted interest and have been studied as potential replacements for devices such as CRT or LCD displays.

In particular, an active matrix type EL display device in which a switching element, such as a thin film transistor (TFT), for individually controlling the EL element is provided in each pixel to thereby control the EL element for each pixel is expected to be able to provide a highly precise display device.

FIG. 1 illustrates a circuit structure corresponding to one pixel portion of a matrix type (including m rows and n columns) EL display device. In the EL display device, on a substrate, a plurality of gate lines GL extend in the row direction and a plurality of data lines DL and power source lines VL extend in the column direction. The region around the area enclosed by the data line DL, the power source line VL, and the gate line GL corresponds to one pixel region in which an organic EL element 50, a switching TFT (first TFT) 10, a driving TFT (second TFT) 20 for the EL element and a storage capacitor Cs are provided.

The first TFT 10 is connected with the gate line GL and the data line DL and becomes on when a gate signal (a selection signal) is applied to the gate electrode of the TFT 10. At this time, a data signal being supplied to the data line is stored in the storage capacitor Cs which is connected between the first TFT 10 and the second TFT 20. A voltage in accordance with the data signal, which has been supplied via the first TFT 10 and is stored in the storage capacitor Cs, is applied to the gate electrode of the second TFT 20, which then supplies a current in accordance with the gate voltage from the power source line VL to the organic EL element 50. By this operation, the organic EL element for each pixel emits light with an emission intensity in accordance with the data signal, this displaying a desired image.

Each of the EL elements in an organic EL display device is a driven-by-current type emissive element which emits light in accordance with a current flowing between an anode and a cathode. Therefore, the power consumption of the panel varies depending on the number of elements which emit light on the panel, and the power consumption as a whole increases as the number of emitting points increases.

However, with the recent increase of electronic devices such as a display of a mobile telephone, for which low power consumption is an essential requirement, in order to use an organic display device as a display of such an electronic device it is necessary to control the power consumption of the display, and particularly to reduce the maximum power consumption. Further, since the organic EL element generates heat by being driven with a current, there is a possibility that the value of the current flowing in the organic EL element will increase even if the voltage at the power source line VL is at a fixed level, which causes further unnecessary power consumption. In view of such a disadvantage, it is highly desired to control an amount of current flowing in the EL element.

SUMMARY OF THE INVENTION

The present invention was conceived in view of the aforementioned problems of the prior art and aims to enable control of the maximum power consumption of a display device such as an EL panel.

In order to achieve the above object, in accordance with one aspect of the present invention, there is provided a display device comprising a display section including a plurality of pixels, each pixel having a driven-by-current type emissive element which includes at least an emissive layer between an anode and a cathode; a power source section for generating a current to cause the driven-by-current type emissive element in the display section to emit light; and a current control section for controlling an amount of current to be supplied to the driven-by-current type emissive element in accordance with an amount of current flowing from the power source section to the display section.

A driven-by-current type emissive element such as an electroluminescence element emits light in proportion to a current being supplied. Therefore, as the number of pixels which emit light in the display section increases, a current flowing from the power source to the display section increases, thereby increasing the power consumption of the device. According to the present invention, as the amount of current to be supplied to each driven-by-current type emissive element is controlled in accordance with the amount of current flowing from the power source toward the display section, the current flowing through each element is restricted to an appropriate range in the display section as a whole even when a large number of elements emit light, thereby reducing the maximum power consumption.

In accordance with another aspect of the present invention, in the above display device, the current control section is provided between the power source section and each driven-by-current type emissive element of the display section.

In accordance with still another aspect of the present invention, in the above display device, the current control section reduces a power source voltage to be applied to each driven-by-current type emissive element to thereby decrease an amount of current to be supplied to each driven-by-current type emissive element when the amount of current flowing from the power source section to the display section increases. By reducing the power source voltage applied to the element under the above control, it is possible to reduce a current flowing through the element easily and reliably.

In accordance with a further aspect of the present invention, in addition to, or independent from, the above control, the current control section controls contrast or brightness level of display data to be supplied to the driven-by-current type emissive element.

In accordance with a further aspect of the present invention, the current control section reduces contrast or brightness level of the display data when the amount of current flowing from the power source section to the display section increases.

Each of the driven-by-current type emissive elements emits light when a current in accordance with the display data flows therethrough. Therefore, when the current to be supplied to the display section from the power source section increases, by reducing the contrast or brightness level of the display data, the amount of current flowing through each element is decreased, thereby ensuring reduction of the power consumption in the display section.

The driven-by-current type emissive element may be, for example, an organic electroluminescence element. By controlling the amount of current to be supplied to the organic EL element, it is possible to prevent an excessive current from flowing through this element, which further contributes to prolonged life and improved reliability of the element.

As described above, according to the present invention, the amount of current to be applied to the driven-by-current type emissive element such as each electroluminescence element is controlled in accordance with the amount of current flowing from the power source to the display section, so that the power consumption of the display section as a whole can be restricted within a predetermined range. Further, when a large number of pixels emit light in the display section, it is possible to prevent the display from being too bright and difficult to view by reducing the increased amount of current.

BRIEF DESCRIPTION OF THE DRAWINGS

These and other objects of the invention will be explained in the description below, in connection with the accompanying drawings, in which.

DETAILED DESCRIPTION OF THE PREFERRED EMBODIMENT

A preferred embodiment (hereinafter referred to as "embodiment") of the present invention will be described in further detail with reference to the accompanying drawings.

Figure 1:
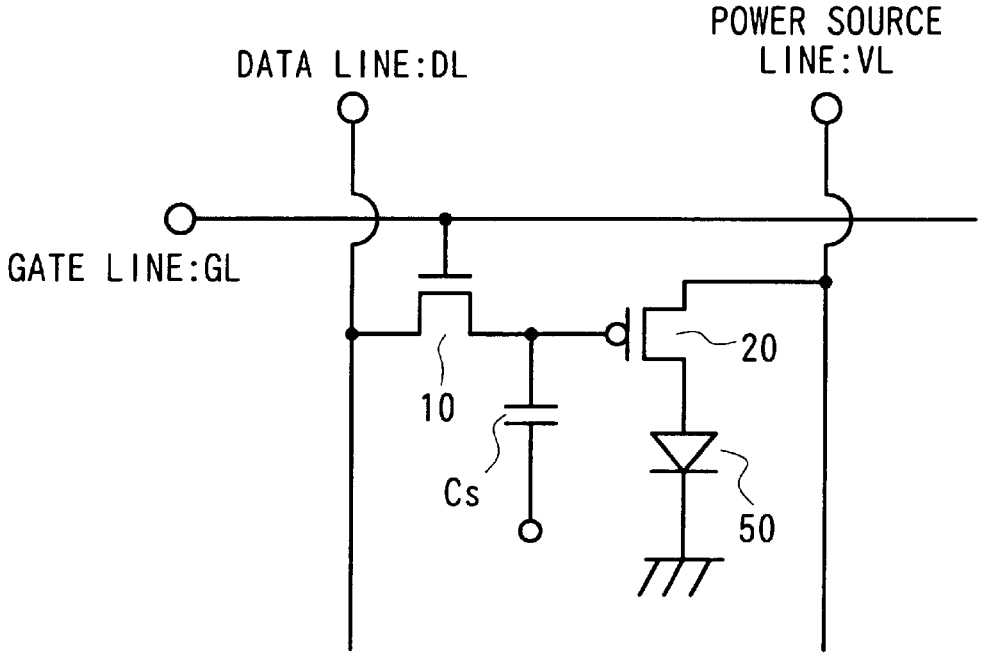
Fig. 1 PRIOR ART
FIG. 1 is a diagram showing a circuit structure corresponding to one pixel portion of an active matrix type organic EL display device of a prior art.
Figure 2:
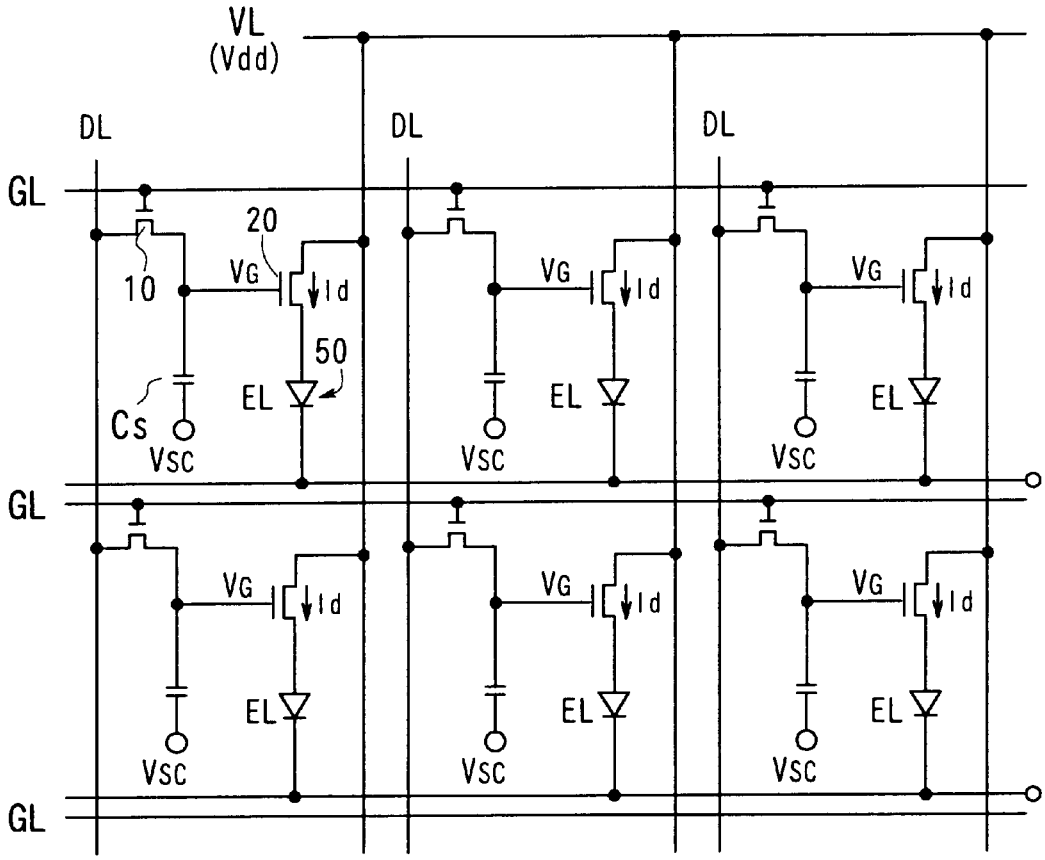
FIG. 2 is a diagram showing a circuit structure of an organic EL panel according to an embodiment of the present invention.

FIG. 2 illustrates a circuit structure of a display section of an active matrix type EL display device including m rows and n columns in accordance with one embodiment of the present invention. The structure shown in FIG. 2 is basically similar to the above-described structure in FIG. 1. Each of a plurality of pixels included in the display section is provided in the vicinity of the area enclosed by a gate line GL extending in the row direction, and a data line DL and a power source line VL both extending in the column direction. Each pixel includes an organic EL element 50, a switching TFT (first TFT) 10, an element driving TFT (second TFT) 20 and a storage capacitor Cs. The first TFT 10 becomes on when a gate signal is applied to the gate thereof. A data signal supplied from the data line DL is stored in the storage capacitor connected between the first TFT 10 and the second TFT 20. The second TFT 20 is provided between the power source line VL and the organic EL element 50 (an anode of the element), and causes a current in accordance with a voltage value of the data signal applied to the gate thereof to be supplied to the organic EL element 50 from the power source line VL.

Figure 3:
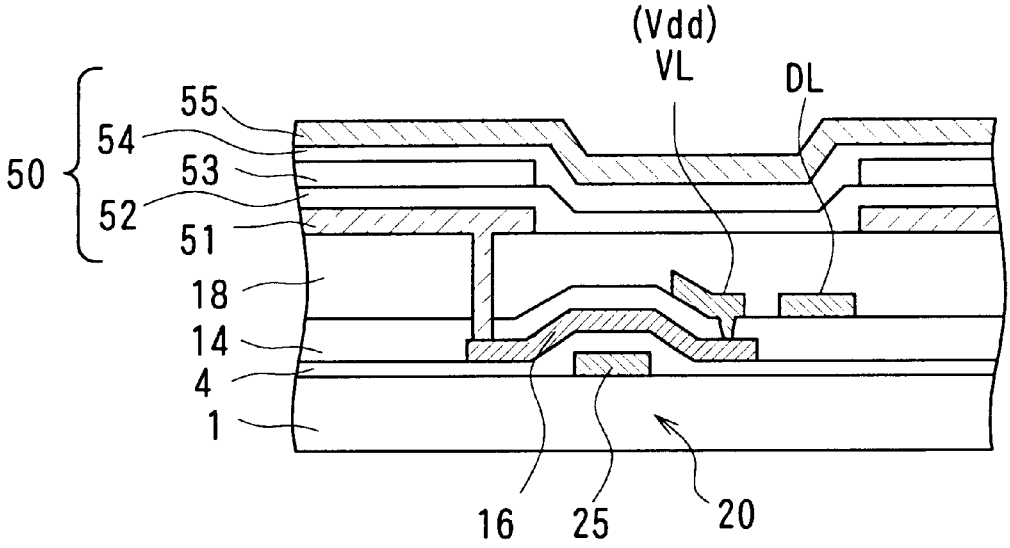
FIG. 3 is a cross sectional view schematically showing the structure of the organic EL element portion according to the embodiment of the present invention.

FIG. 3 is a cross-sectional view showing an example structure of the organic EL element 50 and the second TFT 20. In this embodiment, both the first and second TFTs 10, 20 are bottom gate type TFTs, in which a polycrystalline silicon layer formed by polycrystallization using laser annealing or the like is used for an active layer (though the first TFT 10 is not shown in FIG. 3). Over the entire surface of the substrate covering the first and second TFTs 10 and 20, a planarization insulating layer 18 is formed for surface planarization, and the organic EL element 50 is formed on the planarization insulating layer 18. Specifically, the organic EL element 50 is composed of an anode (first electrode: transparent electrode) 51, a cathode (second electrode: metal electrode) 55 which is formed on the top of the organic EL element 50 as a common electrode for pixels, and an organic layer disposed between the anode 51 and the cathode 55. These layers are disposed in a laminate structure. The anode 51 is connected with the source region of the second TFT 20 through a contact hole formed so as to penetrate through the planarization insulating layer 18 and an interlayer insulating film 14. Further, the organic layer is formed, for example, of a hole transport layer 52 (first hole transport layer, second hole transport layer), an organic emissive layer 53, and an electron transport layer 54 which are arranged in that order from the anode side in a laminate structure.

According to the present embodiment, in the organic EL element 50, the anode 51 formed of ITO (Indium Tin Oxide) or the like and the organic emissive layer 53 are formed individually for each pixel, and the hole transport layer 52 and the electron transport layer 54 are formed as a common layer for each pixel. For example, the first hole-transport layer may be formed of MTDATA (4,4',4"-tris(3-methylphenylphenylamino)triphenylamine), and the second hole-transport layer may be formed of TPD (N,N'-diphenyl-N,N'-di(3-methylphenyl)-1,1'-biphenyl-4,4'-diamine). The organic emissive layer 53 includes, for example, $BeBq_2$ (bis(10-hydroxybenzo[h]quinolinato)beryllium) including quinacridone derivative, although the material differs for each pixel depending on the intended color to be emitted, namely R, G, or B. The electron transport layer 54 may be formed of $BeBq_2$, for example.

Figure 4:
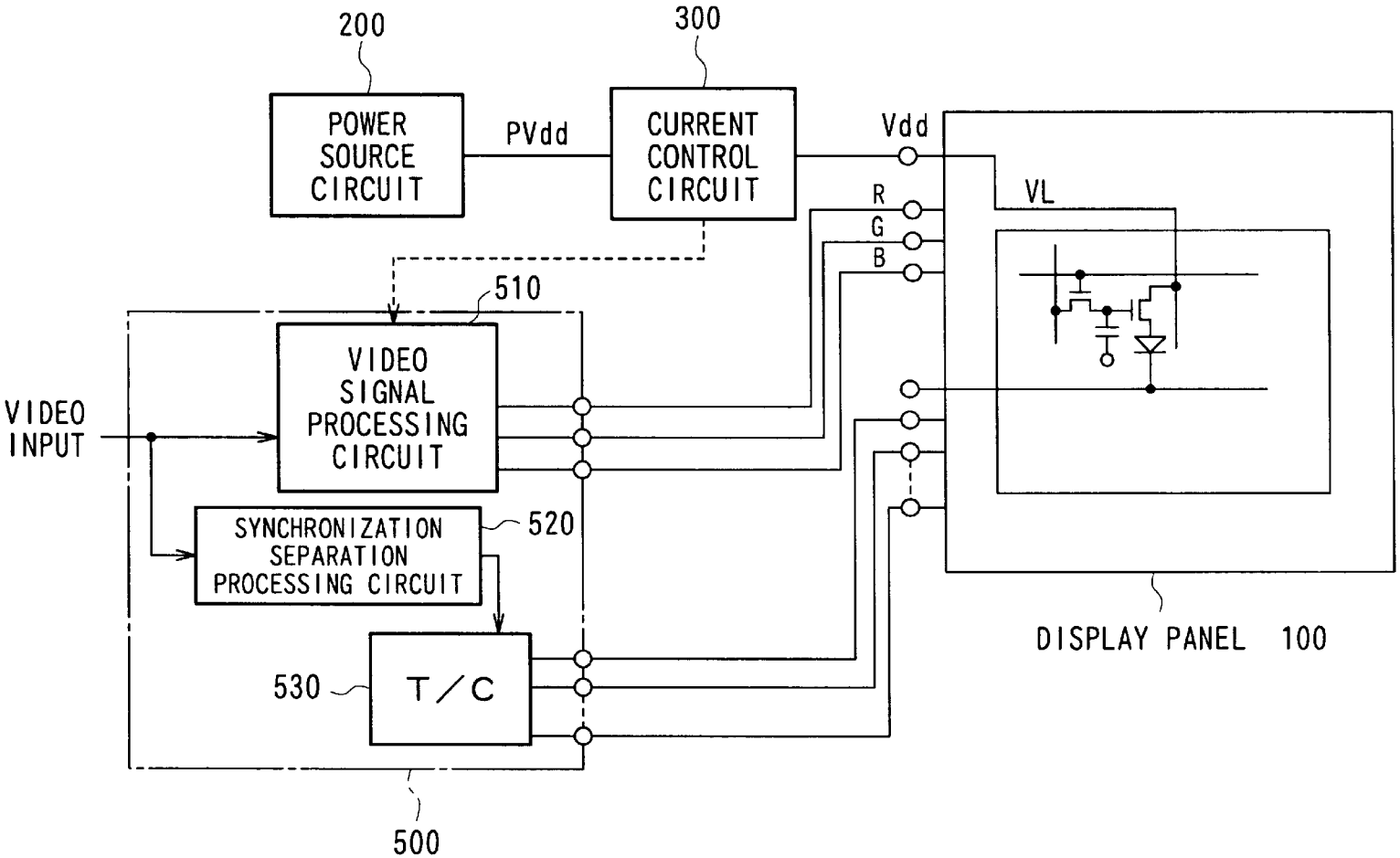
FIG. 4 is a block diagram showing the overall structure of an organic EL display device according to the present invention.

FIG. 4 schematically illustrates an overall structure of an electroluminescence display device according to the present embodiment. The display device comprises a display panel 100 having a circuit structure shown in FIG. 2, a power source circuit 200, a current control circuit 300, and a display controller 500. The power source circuit 200 generates a drive current to be applied to the organic EL element 50. The current control circuit 300, which is provided between the power source circuit 200 and the power source line VL of the display panel 100, controls an amount of current to be applied to each organic EL element 50 in accordance with the amount of current flowing from the power source circuit 200 toward the power source line VL, as will be described later. The display controller 500 includes a video signal processing circuit 510, a synchronization separation processing circuit 520, a timing controller (T/C) circuit 530 or the like. The video signal processing section 510 processes a video input to supply R, G, or B display data to the organic EL panel 100. The synchronization separation processing circuit 520 separates a vertical synchronization signal Vsync or a horizontal synchronization signal Hsync from the video input. The T/C circuit 530 generates a timing signal such as a vertical and horizontal start pulse, a horizontal clock, or the like, for driving each pixel of the display panel 100 based on the vertical synchronization signal Vsync or the horizontal synchronization signal Hsync from the synchronization separation processing circuit 520.

The current control circuit 300 will be described. The current control circuit 300 may be formed of a voltage drop component, an inductance component or the like, and may be formed, for example, of a resistor. The power source line VL for supplying electrical power to each EL element is commonly used for each pixel within the panel 100 as shown in FIG. 2, and the amount of current flowing form the power source circuit 200 to the power source line VL increases as the number of elements to emit light increases. The resistor functioning as the current control circuit 300 as in the present embodiment is provided in the path connecting from the power source circuit 200 to the power source line VL, and a voltage drop (RI) in accordance with an amount of current (I) flowing through the resistor (R) is developed. Therefore, as the amount of current flowing through the resistor increases, the voltage drop increases accordingly, so that the power source voltage Vdd applied to the power source line VL is decreased with respect to the power source voltage PVdd generated in the power source circuit 200 by the amount "RI". That is, the power source voltage Vdd becomes equivalent to "PVdd-RI". As described above, in each pixel, the anode of the organic EL element 50 is connected with the power source line VL via the source or drain of the second TFT 20. Accordingly, as the voltage applied to the power source line VL decreases, a current which is to be supplied to the anode of the organic EL element via the second TFT 20 also decreases. Thus, by reducing the power source voltage Vdd supplied to the power source line VL when the amount of current flow between the power source circuit 200 and the power source line VL increases, the current flowing through each organic EL element can be decreased. According to this embodiment, as described above, the power source voltage Vdd is controlled in accordance with the amount of current flowing through the power source line VL from the power source circuit 200, so that the current amount in each of organic EL element 50 can be controlled, thereby restricting the power consumption of the display section as a whole.

Figure 5:
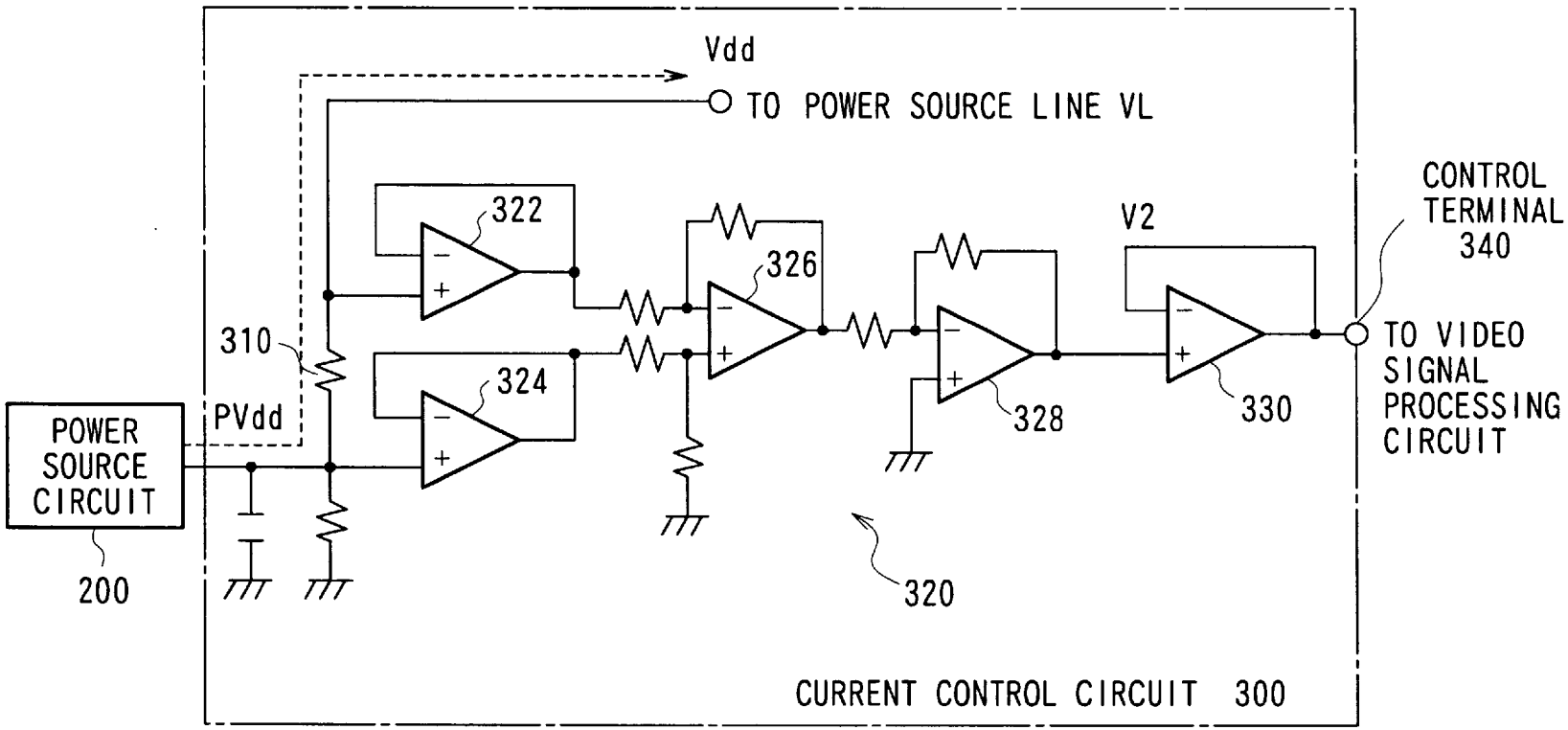
FIG. 5 is a diagram showing an example structure of a current control circuit according to the embodiment of the present invention.

FIG. 5 illustrates another example structure of the current control circuit 300. In this example, the current control circuit 300 generates a control signal in accordance with the amount of current flowing from the power source circuit 200 towards the power source line VL, to thereby control the contrast or brightness level of a video signal to be supplied to each organic EL element 50. The power source voltage Vdd is also controlled simultaneously.

In the current control circuit 300 of FIG. 5, a resistor 310, which is a voltage drop component as in the foregoing example, is provided between the power source circuit 200 and the power source line VL, so that the power source voltage Vdd is decreased by an amount corresponding to a voltage drop in accordance with the amount of current flow between the power source circuit 200 and the power source line VL. The current control circuit 300 further includes, in addition to the resistor 310, a control signal generating section 320 for generating a control signal in accordance with a voltage developed across terminals of the resistor 310. The control signal generated in the control signal generating section 320 is supplied to the video signal processing circuit 510 of the display controller 500 as indicated by a dotted line in FIG. 4. The video signal processing circuit 510 controls the contrast or brightness level of a video signal in accordance with the control signal.

In the example of FIG. 5, the control signal generating section 320 comprises first amplifiers 322, 324, a second amplifier (subtractor) 326, a third amplifier 328, and a fourth amplifier (buffer) 330. The non-inverting inputs of the first amplifiers 322 and 324 are connected with the terminal of the resistor 310 at the power source line side and with the terminal of the resistor 310 at the power source circuit side, respectively. The voltages at the respective terminals of the resistor 310 are converted to have high impedance by the first amplifiers 322, 324, and are then applied to an inverting input and a non-inverting input of the subtractor 326, respectively. When the voltage across the terminals of the resistor 310, namely the voltage drop, is high, the absolute value of the output voltage (differential output) from the subtractor 326 is large. In the circuit structure of FIG. 5, the subtractor 326 applies inverting amplification to the voltage across the terminals. The third amplifier 328 inverts the polarity of the differential output which has been subjected to inverting amplification, before outputting the signal to the fourth amplifier 330. The fourth amplifier 330 performs impedance conversion of the signal supplied from the third amplifier 328 and supplies the resultant signal, as a control signal, to a control terminal. The control signal thus generated and output from the control terminal is a voltage signal corresponding to the voltage drop at the resistor 310, namely the amount of current flowing through the power voltage line VL from the power source circuit.

Figure 6:
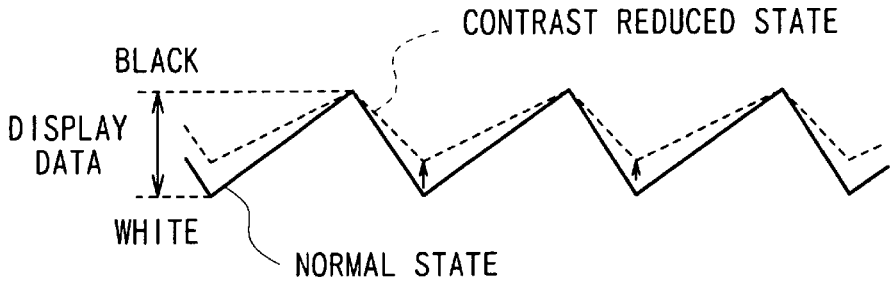
FIG. 6 is a diagram for explaining a method of controlling contrast reduction according to the embodiment of the present invention.

Referring to FIG. 6, how the video signal processing circuit 510 controls the contrast of the display data based on the above-described control signal will be described. In FIG. 6, the solid line indicates, in a simplified manner, display data formed in the normal state. The lowest level of the display data corresponds to the maximum brightness level (white) in the EL element 50 and the highest level of the data corresponds to the minimum brightness level (black).

The organic EL element 50 emits light when a current in accordance with the amplitude of such a video signal (the display data) flows therethrough. Accordingly, in order to reduce the contrast of the display data, the video signal processing circuit 510 raises the lowest level of the display signal in accordance with the control signal to thereby reduce the difference between the maximum brightness level and the minimum brightness level as indicated by a dotted line in FIG. 5, and compresses the amplitude of the display data almost evenly such that the display data amplitude falls within a range between the new minimum level and the maximum level. Such amplitude compression can be implemented by, for example, making the voltage step for one tone smaller than that in the normal state when the tone data contained in a digital video signal is converted to analog data.

Thus, the degree of rise for the minimum level (white level) of the display signal is determined in accordance with the control signal (voltage level) output from the current control circuit 300 and the current in correspondence with the above display signal is then supplied to the organic EL element, so that the amount of current to be supplied to each organic EL element is decreased by an amount corresponding to a raise in the minimum level of the display data. As the power consumption of the organic EL element decreases as the amount of current flowing through the element decreases, it is possible to restrict the power consumption of the organic EL element by means of the above-mentioned contrast control. Further, in this contrast reducing process, as the amplitude of the display data is evenly compressed, the reproducibility of the display data (particularly, of tone) is not lost and the reproducibility obtained in the normal state (when such contrast control is not performed) can be maintained. Thus, due to such contrast control, the power consumption of the display device can be restricted without lowering the data reproducibility.

Figure 7:
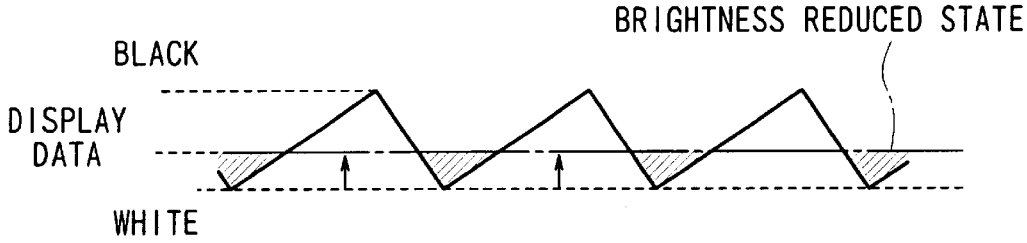
FIG. 7 is a diagram for explaining a method of controlling brightness reduction according to the embodiment of the present invention.

FIG. 7 conceptually illustrates a method of controlling the brightness level of the display data based on the control signal. As in FIG. 6, in FIG. 7, the solid line indicates a simplified waveform of the display data formed in the normal state. In brightness level control, the video signal processing section 510 raises the minimum brightness level as indicated by the dash-dot line in FIG. 7 in accordance with the control signal supplied from the current control circuit 300. Such a rise in the minimum brightness level of the display data corresponds to reduction in the maximum brightness (white) level when attention is focused on the emission brightness of the EL element. Due to the brightness level control, the white level display which does not reach this dash-dot line in the normal state (corresponding to hatched portions in FIG. 7) is restricted to the white level display at the level of the dash-dot line which is newly set in accordance with the voltage level of the control signal. Such brightness restriction processing can be implemented by restricting the brightness level of all the data exceeding the highest limit which is newly set to that highest limit level when the digital brightness data contained in a digital video signal is converted to analog data.

Thus, it is also possible to restrict the amount of current flowing through the organic EL element to thereby reduce the power consumption of the element, by restricting the minimum level (the maximum brightness level) of the display data in a manner shown in FIG. 7 in accordance with the control signal supplied from the current control circuit 300.

By performing the contrast control or the brightness level control as shown in FIGS. 6 and 7, sufficient restriction of the power consumption can be achieved even if the power source voltage control effect provided by the resistor 310 of FIG. 5 is small. Further, in the circuit of FIG. 5, a component capable of detecting a current, such as a coil, may be used instead of the resistor 310, such that a control signal can be generated by detecting an amount of current flowing from the power source circuit 200 toward the power source line VL without particularly controlling the power source voltage Vdd.

While an active matrix type EL display device has been described in the foregoing examples, the present invention is similarly applicable to a passive type EL display device having no switching element in each pixel. Specifically, the maximum power consumption of the device can be reduced by controlling the amount of current flowing between EL elements based on the amount of current flowing through the power source circuit and the power source line of the panel. Further, the emissive element is not limited to an organic EL element, and the maximum power consumption of the display device can be restricted if a device using another type of driven-by-current type emissive element has the structure as described above.

While the preferred embodiment of the present invention has been described using specific terms, such description is for illustrative purposes only, and it is to be understood that changes and variations may be made without departing from the spirit or scope of the appended claims.

What is claimed is:

1. A display device comprising:

a display section including a plurality of pixels, each pixel having a driven-by-current type emissive element which includes at least an emissive layer between an anode and a cathode;

a power source section for generating a current to cause said driven-by-current type emissive element in said display section to emit light; and a current control section for controlling an amount of current to be supplied to said driven-by-current type emissive element in accordance with an amount of current flowing from said power source section to said display section, wherein said current control section is provided between said power source section and the driven-by-current type emissive element of said display section.

2. A display device according to claim 1, wherein said current control section reduces a power source voltage to be applied to said driven-by-current type emissive element to decrease an amount of current to be supplied to said driven-by-current type emissive element when the amount of current flowing from said power source section to said display section increases.

3. A display device according to claim 1, wherein said current control section controls contrast or brightness level of display data to be supplied to said driven-by-current type emissive element.

4. A display device according to claim 3, wherein said current control section reduces contrast or brightness level of said display data when the amount of current flowing from said power source section to said display section increases.

5. A display device according to claim 1, wherein said driven-by-current type emissive element is an organic electroluminescence element.

6. A display device according to claim 1, wherein said current control section is provided between said power source section and the driven-by-current type emissive element of said display section, and said current control section reduces a power source voltage to be applied to said driven-by-current type emissive element to thereby decrease an amount of current to be supplied to said driven-by-current type emissive element when the amount of current flowing from said power source section to said display section increases.

7. A display device according to claim 6, wherein said current control section controls contrast or brightness level of display data to be supplied to said driven-by-current type emissive element.

8. A display device according to claim 7, wherein said current control section reduces contrast or brightness level of said display data when the amount of current flowing from said power source section to said display section increases.

9. A display device according to claim 6, wherein said driven-by-current type emissive element is an organic electroluminescence element.

10. A display device according to claim 1, wherein the current control section is a voltage drop element that causes a voltage drop according to a current amount, and the current drop element is a resistor.

11. A display device comprising:

a display section including a plurality of pixels, each pixel having a driven-by-current type emissive element which includes at least an emissive layer between an anode and a cathode;

a power source section for generating a current to cause said driven-by-current type emissive element in said display section to emit light; and a current control section for controlling an amount of current to be supplied to said driven-by-current type emissive element in accordance with an amount of current flowing from said power source section to said display section, wherein each pixel has a driving thin film transistor to which a current of an amount controlled according to display data is supplied, and the current control section controls an amount of current to be supplied to the driving thin film transistor.

12. A display device according to claim 11, wherein said current control section reduces a power source voltage to be applied to said driven-by-current type emissive element to decrease an amount of current to be supplied to said driven-by-current type emissive element when the amount of current flowing from said power source section to said display section increases.

13. A display device according to claim 11, wherein said current control section controls contrast or brightness level of display data to be supplied to said driven-by-current type emissive element.

14. A display device according to claim 13, wherein said current control section reduces contrast or brightness level of said display data when the amount of current flowing from said power source section to said display section increases.

15. A display device according to claim 11, wherein said driven-by-current type emissive element is an organic electroluminescence element.

16. A display device according to claim 11, wherein said current control section is provided between said power source section and the driven-by-current type emissive element of said display section, and said current control section reduces a power source voltage to be applied to said driven-by-current type emissive element to thereby decrease an amount of current to be supplied to said driven-by-current type emissive element when the amount of current flowing from said power source section to said display section increases.

17. A display device according to claim 16, wherein said current control section controls contrast or brightness level of display data to be supplied to said driven-by-current type emissive element.

18. A display device according to claim 17, wherein said current control section reduces contrast or brightness level of said display data when the amount of current flowing from said power source section to said display section increases.

19. A display device according to claim 16, wherein said driven-by-current type emissive element is an organic electroluminescence element.

20. A display device according to claim 11, wherein the current control section is a voltage drop element that causes a voltage drop according to a current amount, and the current drop element is a resistor.

* * * * *